United States Patent [19]

Muller

[11] 4,101,982

[45] Jul. 25, 1978

[54] PANTY HOSE GARMENT AND METHOD OF MANUFACTURE THEREOF

[76] Inventor: David Muller, 7053 Guelph, Cote St. Luc, Quebec, Canada

[21] Appl. No.: 725,094

[22] Filed: Sep. 17, 1976

[51] Int. Cl.[2] ..... A41B 9/04

[52] U.S. Cl. ..... 2/409; 2/408

[58] Field of Search ..... 2/409, 408, 407, 227, 2/243 R

[56] References Cited

U.S. PATENT DOCUMENTS

| | | | |
|---|---|---|---|
| 3,613,119 | 10/1971 | Sarmiento | 2/407 |
| 3,777,764 | 12/1973 | Herbener | 2/409 |

FOREIGN PATENT DOCUMENTS

| | | | |
|---|---|---|---|
| 899,434 | 6/1962 | United Kingdom | 2/409 |

*Primary Examiner*—H. Hampton Hunter

*Attorney, Agent, or Firm*—Bernard Malina

[57] ABSTRACT

A panty hose garment has a panty portion of increased width to accomodate and provide an improved fit for large hip sizes. The garment is produced by forming a longitudinal slit in first and second tubular knit blanks extending from their respective open ends intermediate the front and rear thereof and forming diametrically opposed first and second slits in a third tubular blank of reduced size intermediate the front and rear thereof. The edge of slit in the first tubular blank is seamed to the edge of the first slit of the third tubular blank and the edge of the slit of the second tubular blank is seamed to the edge of the second slit of the third tubular blank. The garment thus formed includes a panty portion comprising the slit upper welt portions of a pair of tubular blanks respectively seamed to the diametrically opposite slits of a third central tubular blank of reduced length.

10 Claims, 9 Drawing Figures

FIG. 5
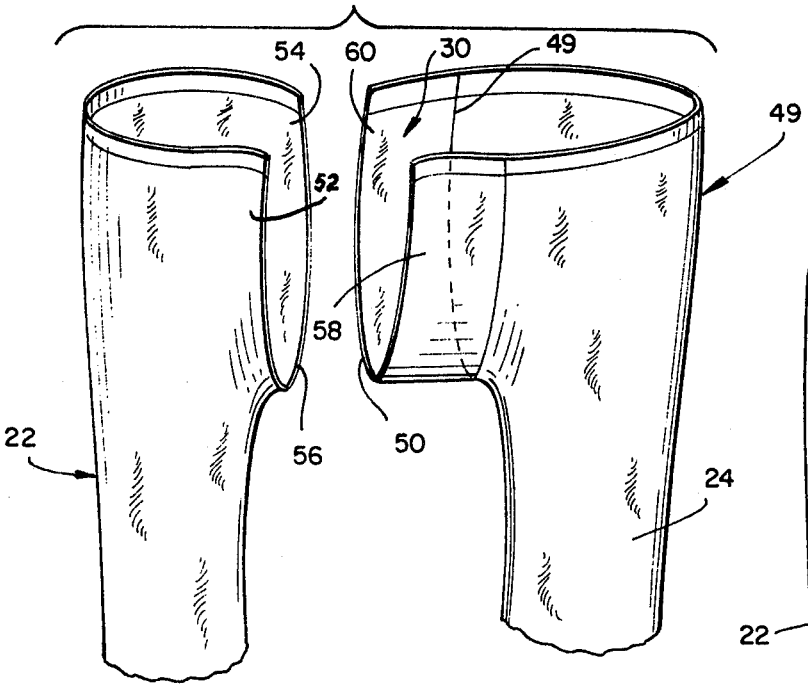
FIG. 6
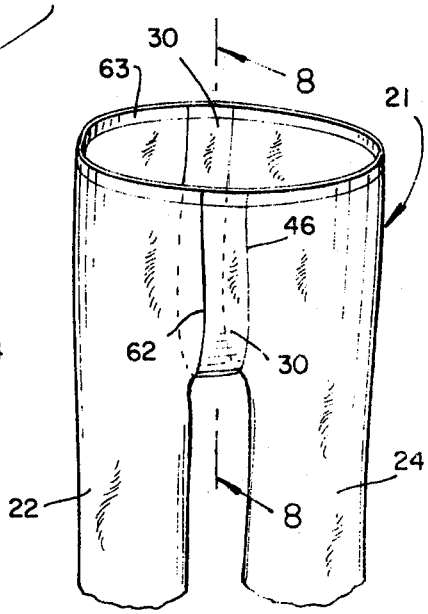
FIG. 7
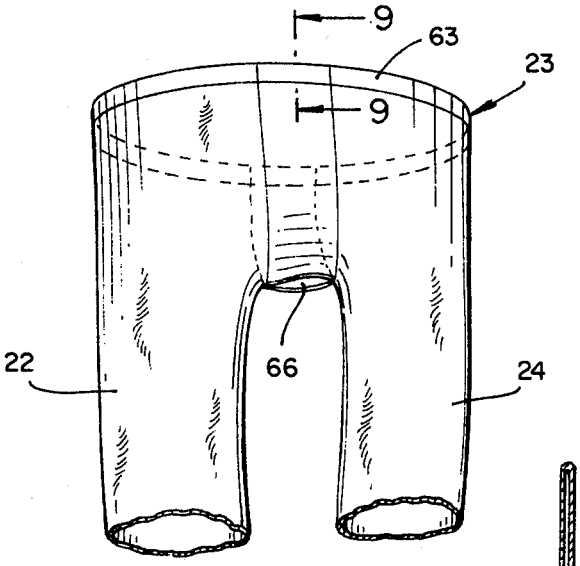
FIG. 8
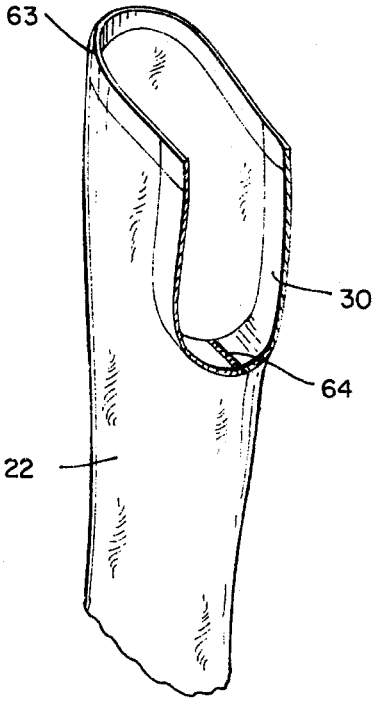
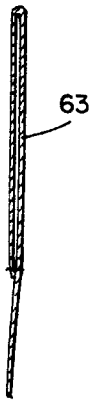
FIG. 9

PANTY HOSE GARMENT AND METHOD OF MANUFACTURE THEREOF

BACKGROUND OF THE INVENTION

The present invention relates to panty hose garments and more particularly to a panty hose garment particularly suited for larger hip-sized wearers.

In the manufacture of conventional panty hose, two identical seamless tubular sleeves (i.e. blanks) are knit and vertical slits are respectively formed in the welts thereof. The corresponding edges of the slits are then aligned and seamed to form a garment in which a single continuous U-seam extends downwardly from the waist opening through the crotch portion and vertically upwardly in the rear seat portion of the panty. Such conventional type of panty hose known as the "U-seam" construction is shown in U.S. Pat. Re. No. 25,360.

In the U-seam panty hose resulting from the foregoing method of manufacture, the panty portion is identically dimensioned in the front and rear panels thereof. In such conventional U-seam panty hose, although the knitted nylon fabric in the garment to some extent stretches to accomodate the natural protuberances of the body of the wearer, i.e. buttocks, hips and stomach, the increased stretching causes the waistline to sink when the wearer is seated and the panty crotch to "bag" resulting in a rather poor fit.

Furthermore, even in the standing position, an increased hip size will cause lateral stretching of the panty portion thus distorting the fit of the panty portion.

Various knitted and sewn constructions have been suggested to provide increased fullness and/or elasticity in the rear panel of the panty portion in order to overcome or, at least, mitigate the foregoing deficiencies in fit of conventional U-seam panty hose. Such suggested constructions, however, require some complicated machinery for carrying out the various types of knitting and sewing steps, thus substantially increasing the cost of manufacture of the finished product.

Since the conventional single U-seam panty hose has been known for some time, there presently exist highly developed automatic panty hose crotch closing machines for manufacturing such panty hose garments. Furthermore, in view of the relatively economical cost of manufacture thereof as compared with panty hose having a modified knitted rear panel construction, as described above, a substantial demand for conventional U-seam panty hose presently exists and probably will continue to exist. Accordingly, relatively small panty hose manufacturers are reluctant to dispose of their existing U-seam panty hose crotch closing machine.

It is therefore an object of the present invention to provide panty hose economical to manufacture and which provides an improved fit in the panty portion thereof.

It is a further object of the present invention to provide panty hose which comprises a panty portion constructed so as to conformably accomodate larger than average hip dimensions of the wearer.

It is yet another object of the present invention to provide a method of manufacture of panty hose of the character described which method utilizes existing automatic panty hose crotch closing machines presently used for manufacturing conventional U-seam panty hose.

SUMMARY OF THE INVENTION

In accordance with the principles of the present invention there is provided a combination stocking-panty garment comprising first and second tubular blanks respectively open at the upper ends thereof and each having a longitudinal slit intermediate the front and rear thereof, and a third tubular blank open at the upper end thereof and having diametrically opposed first and second slits intermediate the front and rear thereof. There is further provided means connecting the edge of the slit of said first tubular blank to the edge of said first slit of said third tubular blank and means connecting the edge of the slit of said second tubular blank to the edge of said second slit of said third tubular blank. The slit portions of said first and second tubular blanks and said third tubular blank define the panty portion of said garment and the remaining portions of said first and second tubular blanks define the stocking portions of said garment.

Further objects, features and advantages of this invention will become apparent from a consideration of the following description, the appended claims and the accompanying drawings in which:

BRIEF DESCRIPTION OF THE DRAWINGS

FIG. 5 illustrates a stage in the manufacture of the panty hose garment of FIG. 1 subsequent to that shown in FIG. 4;

FIG. 6 is a perspective view of the top portion of the panty hose garment of FIG. 2;

FIG. 7 is a perspective view of the top portion of a panty hose garment in accordance with the present invention in a second embodiment thereof;

FIG. 8 is a section view taken along the line 8—8 in FIG. 6; and

FIG. 9 is a section view taken along the line 9—9 in FIG. 7.

DETAILED DESCRIPTION OF THE INVENTION

Figure 1:
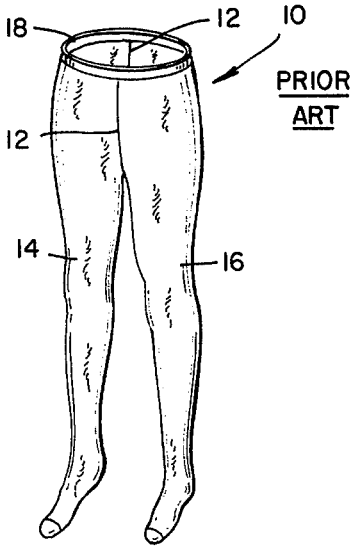
FIG. 1 is a perspective view of a prior art panty hose garment having a single U-seam panty construction.

In FIG. 1 of the drawings there is shown a conventional panty hose garment 10 having a single central U-seam 12. As indicated hereinabove, in the manufacture of panty hose garment 10, longitudinal slits are made in the welts of two identical tubular blanks 14 and 16, and the resulting flaps are then aligned and sewn together by a continuous seam 12 to form a single enlarged welt at the top serving as the panty portion of the garment 10. An elastic waistabnd 18 is then sewn to the peripheral edge of the panty opening. It will be evident from the foregoing description of the manufacture thereof, that in U-seam pantyhose garment 10 the front half of the panty portion is identical in size and shape to the rear seat half thereof. Thus, due to the increased protrusion of the buttocks in the rear half of the panty portion, the resultant increased stretching of the rear seat half causes the panty waistband 18 to sink, this distortion being even more pronounced when the wearer is seated.

The tubular blanks 14 and 16 of garment 10 are substantially uniform in diameter throughout their length. However, even in the case of slender figures, the hip measurement is generally considerably greater than twice the thigh circumference. Accordingly, the panty portion of garment 10 will be subject to greater stretching than in the thigh portions of stockings 14 and 16. Of course, such increased lateral stretching of the panty portion and resultant impairment of the garment fit is more pronounced in the case of persons having a large hip dimension.

Figure 2:
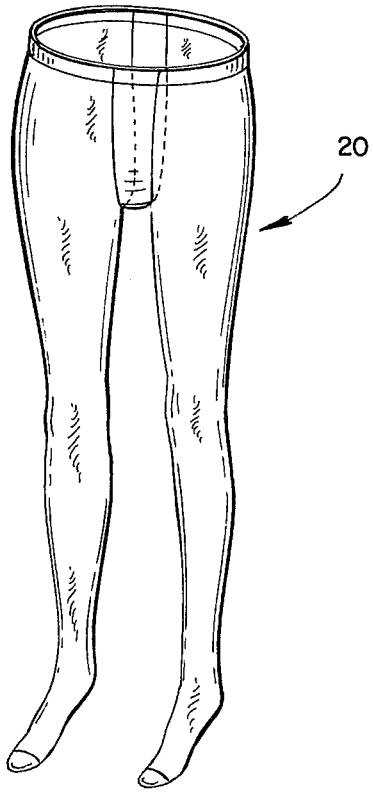
FIG. 2 is a perspective view of a panty hose garment in accordance with the present invention in one embodiment thereof.

Referring now to FIG. 2, a panty hose garment in accordance with the principles of the present invention in one embodiment thereof is generally designated by the numeral 20, the method of manufacture thereof being illustrated in FIGS. 3–9 and described below.

Figure 3:
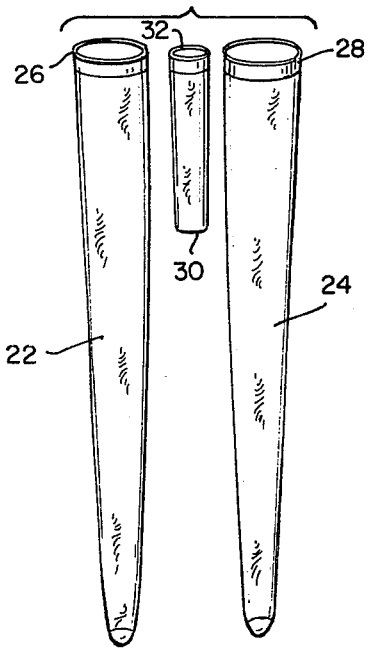
FIG. 3 is a perspective view of the component blanks for the manufacture of the panty hose garment of FIG. 1 in the first stage of such manufacture.

Referring to FIG. 3, the first step in the manufacture of panty hose garment 20 is similar to that of prior art garment 10. Thus, a pair of circularly knit tubular stocking blanks 22 and 24 may be formed by a conventional hosiery knitting machine, for example, of the type employed in the manufacture of blanks 14 and 16 of garment 10. The same knitting machine employed for knitting tubular blanks 22 and 24 may be utilized to knit a third tubular blank 30 which is similar in construction, but of reduced length and, if desired, reduced in diameter as compared to stocking blanks 22 and 24. For reasons which will hereinafter become apparent, the length of blank 30 generally corresponds to the "rise", i.e. the distance from the waistline to the crotch, of the completed panty hose garment 20. Each of the tubular blanks 22, 24 and 30 may be provided with integrally formed waistbands 26, 28 and 32 respectively.

Figure 4:
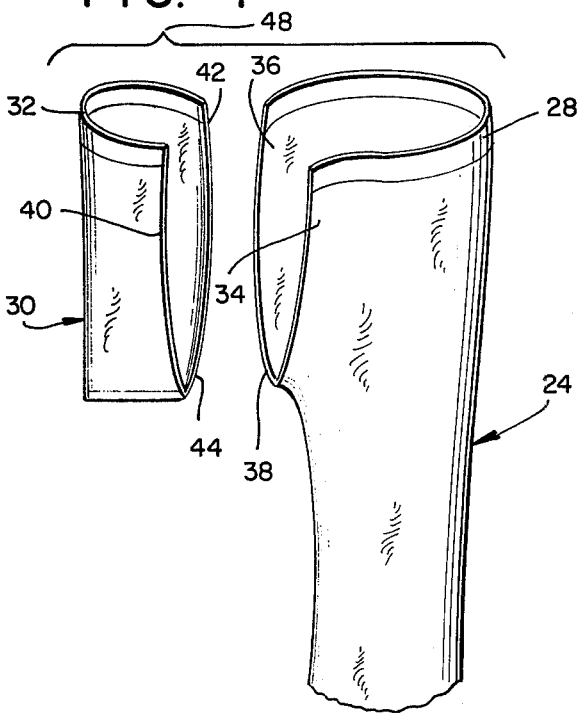
FIG. 4 illustrates a subsequent stage in the manufacture of the panty hose garment of FIG. 2.

Referring to FIG. 4, a longitudinal slit is then made in stocking blank 24 extending from waistband 28 downwardly to a length substantially corresponding to the length of insert blank 30, thus defining a first U-shaped seaming edge 38 and forming front and rear flaps 34 and 36. In a similar manner, insert blank 30 is slit longitudinally along its entire length to form a second U-shaped seaming edge 44 and front and rear flaps 40 and 42.

Front flaps 34 and 40 as well as rear flaps 36 and 42 are respectively aligned so that seaming edges 38 and 44 are contiguous and coextensive. Edges 38 and 44 may then be seamed together along their entire respective lengths in a conventional U-seaming operation to form a first intermediate stage section 48 having a first U-seam 46.

Referring to FIG. 5, blank 30 is then longitudinally slit along its entire length to form a second seaming edge 50 and front and rear flaps 58 and 60 respectively to form a second intermediate stage section 49.

The other stocking blank 22 is then slit at the upper end thereof in a manner similar to that of stocking blank 24 to form front and rear flaps 52, 54 and a seaming edge 56. Stocking blank 22 is then joined to section 49 by aligning front flap 52 with front flap 58 and rear flap 54 with rear flap 60 so that seaming edges 50 and 56 are contiguous and coextensive. Edges 50 and 56 are then seamed together to form a second U-seam 62 to produce a panty hose garment 21 shown in FIG. 6 having a composite panty portion comprising the slit upper welt portions of stocking blanks 22 and 24 seamed to opposite sides of a doubly slit tubular insert blank 30 and provided with a composite waistband 63 as desired.

An important feature of the composite panty hose garment 21 thus formed is the provision of a panty portion which has an increased lateral circumferential dimension with the garment in the slack condition thereby providing a much better fit for stouter figures.

More importantly, the composite panty hose garment 21 of the present invention may advantageously be manufactured by conventional knitting and panty hose crotch closing machines, as described hereinabove. Thus, stocking tubular blanks 22 and 24 are similar to the tubular blanks 14 and 16 forming the conventional single U-seam panty hose garment 10 of FIG. 1. Insert blank 30, although reduced in length and possibly in width, may be made on the same knitting machine employed for knitting regular stocking blanks 22 and 24. Furthermore, a conventional automatic panty hose crotch closing machine used to perform the slitting and sewing operation in the manufacture of the prior art single U-seam panty hose garment 10 may be similarly employed to carry out the slitting and sewing operations described above and illustrated in FIGS. 4–6. Thus, by way of example only, the Takatori Line Closer automatic panty hose crotch closing machine (not shown) manufactured by Takatori Machinery Mfg. Co. Ltd. of Japan which is widely used to perform the slitting and seaming operations in the manufacture of conventional single U-seam panty hose garments 10 may also be utilized to carry out all the slitting and sewing operations in the manufacture of the panty hose garment 21 of the present invention. In this connection, it will be noted that the slitting and sewing operations in forming first intermediate stage section 48 of FIG. 4 are basically similar to those involved in the manufacture of prior art single U-seam garment 10. Prior to formation of seaming edge 60 in first intermediate stage section 48 the latter is basically a tubular blank, which, together with another tubular blank 22 are to be slit and the corresponding flaps sewn together in a repeat single U-seam operation shown in FIGS. 5 and 6. Thus, briefly, in the manufacture of the prior art single U-seam garment 10 by means of the Takatori Line Closer, the welt portions of a pair of tubular blanks are respectively drawn over two pairs of vertically stacked finger clamps carried on a motor-driven turntable which then rotates the clamped welts to a second position where the welts are automatically slit. The clamped blanks are then rotated to a third position where the finger clamps open and turn over the welt portions. The clamp head carrying the slit and opened welts is then rotated to a fourth position where the slit welts in the open position are sewn together to form a single U-seam after which the clamp head is rotated to a fifth position where the clamp fingers are closed and the upper and lower clamps separated to permit the sewn garment to be slidably removed therefrom.

Yet another important feature of the present invention resides in the fact that since insert panel 30 is originally in the form a tubular blank identical to stocking blanks 22 and 24 except only for its reduced size, insert panel 30 in the completed garment 21 (FIG. 6) blends in with the adjoining stocking panels 22 and 24 since it comprises the identical color, texture and knit thus providing a relatively uniform appearance across the width of the panty portion of garment 21.

The panty hose garment of the present invention may be provided with either a closed or open crotch as required. If a closed crotch garment is desired, such as garment 21 of FIGS. 6 and 8, insert blank 30 is knitted open at the upper end but closed at its lower end ("closed toe") or, alternatively, insert blank 30 may be knitted open at both ends and the lower end may be seamed closed at 64 (FIG. 8). On the other hand, if an open ventilated crotch panty hose garment is desired, such as garment 23 of FIG. 7, insert blank 30 may be knitted open at both ends and then slit and seamed at opposite sides to stocking blanks 22 and 24 as described hereinabove, to provide an open crotch 66.

It will be understood that insert blank 30 may be of uniform diameter or tapered inwardly or outwardly from top to bottom as desired, if a tapered panty portion is desired for improved fit. Furthermore, insert blank 30 may be knitted to provide different variations in the width thereof in order to selectively provide the particular shaping in the width of the panty portion of the panty hose garment 21.

Although the invention has been described with reference to particular embodiments thereof, it is to be understood that such embodiments are merely illustrative of the principles of the invention. Numerous modifications may be made therein and other arrangements may be devised without departing from the spirit and scope of the invention.

What is claimed is:

1. A method of forming a combination stocking-panty garment comprising the steps of:

a. forming a longitudinal slit in each of first and second circular knit tubular blanks intermediate the front and rear thereof;

b. forming first and second diametrically opposed longitudinal slits in a third circular knit tubular blank intermediate the front and rear thereof;

c. seaming the edge of the slit of said first tubular blank to the edge of the first slit of said third tubular blank and seaming the edge of the slit of said second tubular blank to the edge of said second slit of said third tubular blank.

2. A method of forming a combination stocking-panty garment as defined in claim 1 wherein said first, second and third tubular blanks are open at their respective upper ends.

3. A method of forming a combination stocking-panty garment as defined in claim 2 wherein said third tubular blank is of a substantially shorter length than the lengths of said first and second tubular blanks.

4. A method of forming a combination stocking-panty garment as defined in claim 3 wherein said diametrically opposed first and second longitudinal slits in said third tubular blank extend substantially along the entire length thereof.

5. A method of forming a combination stocking-panty garment as defined in claim 4 wherein said longitudinal slits in said first and second tubular blanks extend from the respective open ends thereof for a predetermined length corresponding to the length of said third tubular blank.

6. A combination stocking-panty produced by the following steps:

a. forming a longitudinal slit in each of first and second circularly knit tubular blanks intermediate the front and rear thereof;

b. forming first and second diametrically opposed longitudinal slits in a third circularly knit tubular blank intermediate the front and rear thereof;

c. seaming the edge of the slit of said first tubular blank to the edge of the first slit of said third tubular blank and seaming the edge of the slit of said second tubular blank to the edge of said second slit of said third tubular blank.

7. A combination stocking-panty garment as defined in claim 6 wherein said first, second and third tubular blanks are open at their respective upper ends.

8. A combination stocking-panty garment as defined in claim 7 wherein said third tubular blank is of a substantially shorter length than the lengths of said first and second tubular blanks.

9. A combination stocking-panty garment as defined in claim 8 wherein said diametrically opposed first and second longitudinal slits in said third tubular blank extend substantially along the entire length thereof.

10. A combination stocking-panty garment as defined in claim 9 wherein said longitudinal slits in said first and second tubular blanks extend from the respective open ends thereof for a predetermined length corresponding to the length of said third tubular blank.

* * * * *